US006390268B1

(12) United States Patent
Lonardi

(10) Patent No.: US 6,390,268 B1
(45) Date of Patent: May 21, 2002

(54) DEVICE FOR DISPENSING BULK MATERIALS

(75) Inventor: Emile Lonardi, Bascharage (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/806,945

(22) PCT Filed: Oct. 5, 1999

(86) PCT No.: PCT/EP99/07354

§ 371 Date: Jun. 20, 2001

§ 102(e) Date: Jun. 20, 2001

(87) PCT Pub. No.: WO00/20647

PCT Pub. Date: Apr. 13, 2000

(30) Foreign Application Priority Data

Oct. 6, 1998 (LU) ..... 90295

(51) Int. Cl.[7] ..... B65G 11/00

(52) U.S. Cl. ..... 193/16; 414/160; 266/176

(58) Field of Search ..... 193/2 R, 3, 16; 198/536; 414/160, 199, 206, 208; 266/176, 266, 184, 191, 196

(56) References Cited

U.S. PATENT DOCUMENTS 4,277,214 A * 7/1981 Mahle et al. ..... 193/16 X
5,273,148 A * 12/1993 Lonardi et al. ..... 193/16 X
5,450,936 A * 9/1995 Andonov et al. ..... 193/16 X
6,213,275 B1 * 4/2001 Lonardi et al. ..... 193/16

FOREIGN PATENT DOCUMENTS

| | | |
|---|---|---|
| DE | 2 222 386 | 11/1973 |
| FR | 2 216 350 | 8/1974 |
| FR | 2 230 246 | 12/1974 |
| JP | 5 8210 105 | 5/1982 |

* cited by examiner

*Primary Examiner*—James R. Bidwell
(74) *Attorney, Agent, or Firm*—Oblon, Spivak, McClelland, Maier & Neustadt, P.C.

(57) ABSTRACT

The invention concerns a device for dispensing bulk materials comprising a vertical rotor (22) wherein is suspended a chute (14) so as to pivot about a substantially horizontal pin (26). A guiding device **(68*i*, 70*i*) interlocked in rotation with the rotor (22), is connected between the rotor (22) and a first ring (66), so that the latter can axially slide along the rotor (22). Connecting rods (73, 73') transform a vertical sliding of the first ring (66) causing the chute (14) to pivot. A roller ring (76) connects the first ring (66) to a second ring (74), whereto are connected control means, for example a lever actuated by a hydraulic actuator (80), capable of varying the vertical position of the two rings (66, 74) and the chute (14)** inclination.

12 Claims, 5 Drawing Sheets

DEVICE FOR DISPENSING BULK MATERIALS

Figure 1:
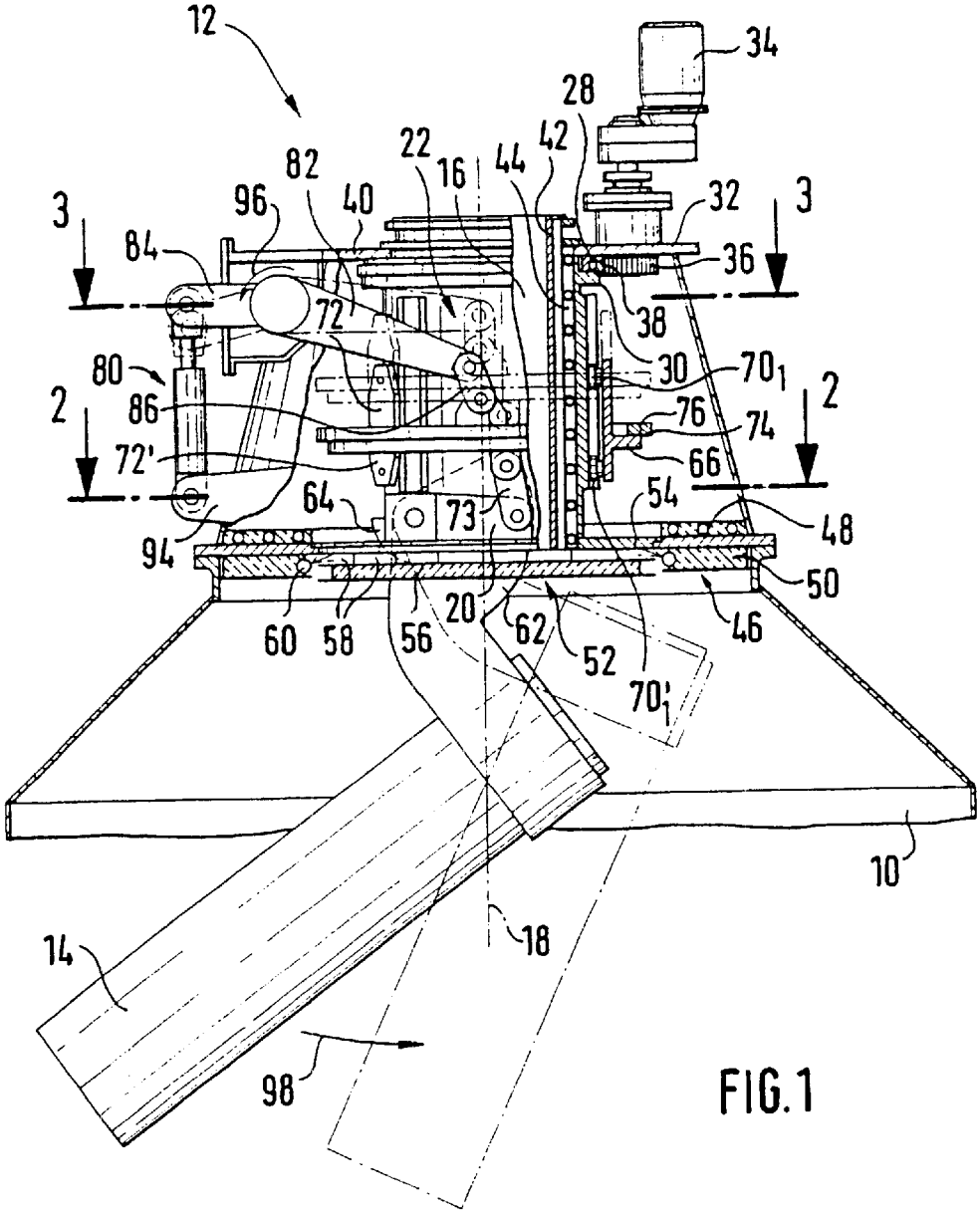

The present invention relates to a device for distributing materials in bulk with a rotary chute having a variable angle of inclination.

Such devices are used, for example, in devices for charging shaft furnaces, particularly blast furnaces, in which a rotary chute with a variable angle of inclination provides for the distribution of the charge inside the shaft furnace. More particularly, they comprise a supporting cage in which a suspension rotor is mounted in such a way that it can be driven in rotation about a substantially vertical rotation axis. The chute is suspended from this rotor so that it can pivot about its suspension axis. A pivoting mechanism makes it possible to change the inclination of the chute during its rotation. The rotor is traversed axially by a feed channel so that the materials in bulk, which flow from a batch hopper in the charging device, are poured into the rotary chute, which distributes them inside the shaft furnace.

Such devices for distributing materials in bulk are, for example, described in the documents WO 95/21272, U.S. Pat. Nos. 5,022,806, 4,941,792, 4,368,813, 3,814,403 and 3,766,868. In these devices, the pivoting mechanism comprises a second rotor, which has a rotation axis substantially coaxial with the first rotor, from which the chute is suspended. This second rotor may be driven in rotation at a different speed from that of the first rotor, which makes it possible to produce a variable angular displacement between the two rotors. A mechanism connected between the second rotor and the chute then enables a variation in the angular displacement between the two rotors to be converted into a variation of the angle of inclination of the chute in its vertical pivoting plane.

A different type of device for the distribution of materials in bulk is known from the document FR 22230246. This device includes an outer casing in which a rotating barrel is supported. This rotating barrel supports an oscillating chute in journals. The journals carry cranks connected by linking rods to a first circular ring. The ladder is locked in rotation with the rotating barrel by fingers that can slide vertically in guides fixed to the rotating barrel and it is carried by a second circular ring on which it is centered and on which it rests and freely rotates through the intermediary of rollers. The second circular ring is supported at several points by linking rods connected to the connecting rods of jacks mounted on the outer casing. By substantially adjusting the vertical position of the second ring using jacks, it is possible to adjust the inclination of the chute.

In general, it is important to note that the torque which must be transmitted to the chute to make it pivot about its horizontal pivoting axis may become very high, particularly if the chute has a very massive construction (as is the case, for example, on blast furnaces), and/or if the pivoting is of large amplitude. It follows that large forces must be transmitted by the pivoting mechanism for the chute.

One of the problems underlying the present invention is that of proposing a device for distributing materials in bulk with a rotary chute having a variable angle of inclination, in which a relatively simple pivoting mechanism for the chute is used, which nevertheless has excellent qualities as regards the transmission of the large forces necessary for the pivoting of the chute.

GENERAL DESCRIPTION OF THE INVENTION

This problem is solved by a device according to the present invention. Such a device comprises, in a way know per se, a suspension rotor mounted in a supporting cage so that it can rotate about a substantially vertical rotation axis. The chute is suspended from this rotor so that it can pivot about a substantially horizontal suspension axis. The suspension rotor is traversed axially by a feed channel for the chute. The device includes a very simple pivoting mechanism for changing the inclination of the chute suspended from the rotor. This mechanism consists of a first and second ring, which are both located around the rotor, so that their central axis is coaxial with the rotation axis of the rotor. A guidance device, locked in rotation with the rotor, is connected between the rotor and the first ring, so that the latter can slide axially along the rotor. At least one connecting element connects the first ring to the chute so as to convert a vertical sliding of the first ring into a pivoting of the chute about its pivoting axis. The first and second rings are connected through the intermediary of a bearing ring. An annular hydraulic jack, which is positioned around the suspension rotor so that its central axis is coaxial with the rotation axis of the latter, is connected to the second ring in order to produce a variation in its vertical position. Hence, by changing, using this annular hydraulic jack, the vertical position of the second non-rotatable ring, the first ring is made to slide vertically along the rotor using the guidance device and this produces a pivoting of the chute about its pivoting axis. It should be appreciated that the mechanism formed by the annular hydraulic jack, the two rings, the bearing ring and the guidance device forms an ingenious and reliable chain of transmission for large pivoting forces.

The chute preferably incorporates two lateral suspension arms and the rotor two lateral bearings in which the suspension arms are suspended so that the chute can pivot about a substantially horizontal axis. Connecting rods can then connect the first ring to each of the suspension arms of the chute so as to convert a vertical sliding of the first ring into a pivoting of the chute around its pivoting axis.

The guidance device connected between the first ring and the rotor preferably consists of several vertical rails mounted on the rotor and rollers mounted on the first ring and guided in the rails. Excellent guidance is obtained when a pair of vertically separated rollers is guided in each rail.

In an alternative embodiment, the means for control used to vary the vertical position of the second ring comprise a lever mechanism and a hydraulic jack which actuates this lever mechanism. This lever mechanism then preferably consists of an intermediate articulated lever provided with a supporting arm and an actuating arm. The supporting arm advantageously has the shape of a fork connected to the second ring at two diametrically opposite points, for example by means of connecting rods. The actuating arm is connected outside the supporting cage to the hydraulic jack so that the latter can be easily replaced and is no longer exposed to a hostile environment inside the supporting cage. If the device for distributing materials in bulk is used, for example, on a shaft furnace, the supporting cage is preferably a sealed structure. The lever then advantageously comprises a suspension pivot which carries the actuating arm and which leaves the supporting cage imperviously through a suspension bearing form, an integral part of the sealed structure.

It should be appreciated that a description is also given of simple and effective methods for protecting the components inside the supporting cage particularly against heat. Thus it is proposed, for example, to insert a non-rotatable tubular screen fitted with a cooling circuit between the feed channel and the suspension rotor. It is also proposed to provide the supporting cage at its lower end with a fixed annular screen, which is fitted with a cooling circuit and defines a circular central opening, while the suspension rotor is fitted at its lower end with a flange which is set with some clearance in this circular central opening. A gas injection pipe is in this case advantageously positioned along the circular central opening of the fixed annular screen so that a coolant gas can be injected into cavities opening into the lateral edge of the flange.

Figure 2:
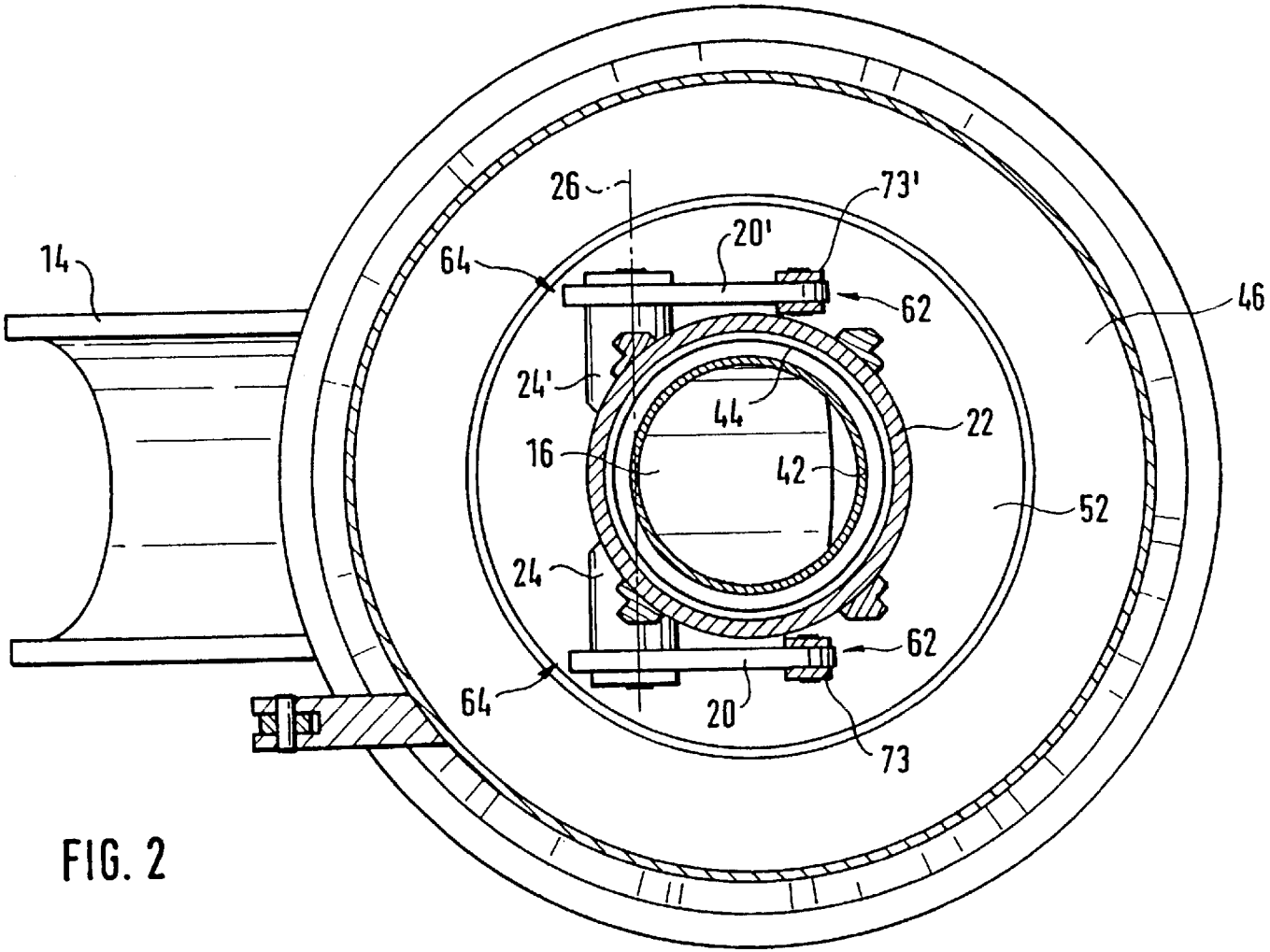
Figure 3:
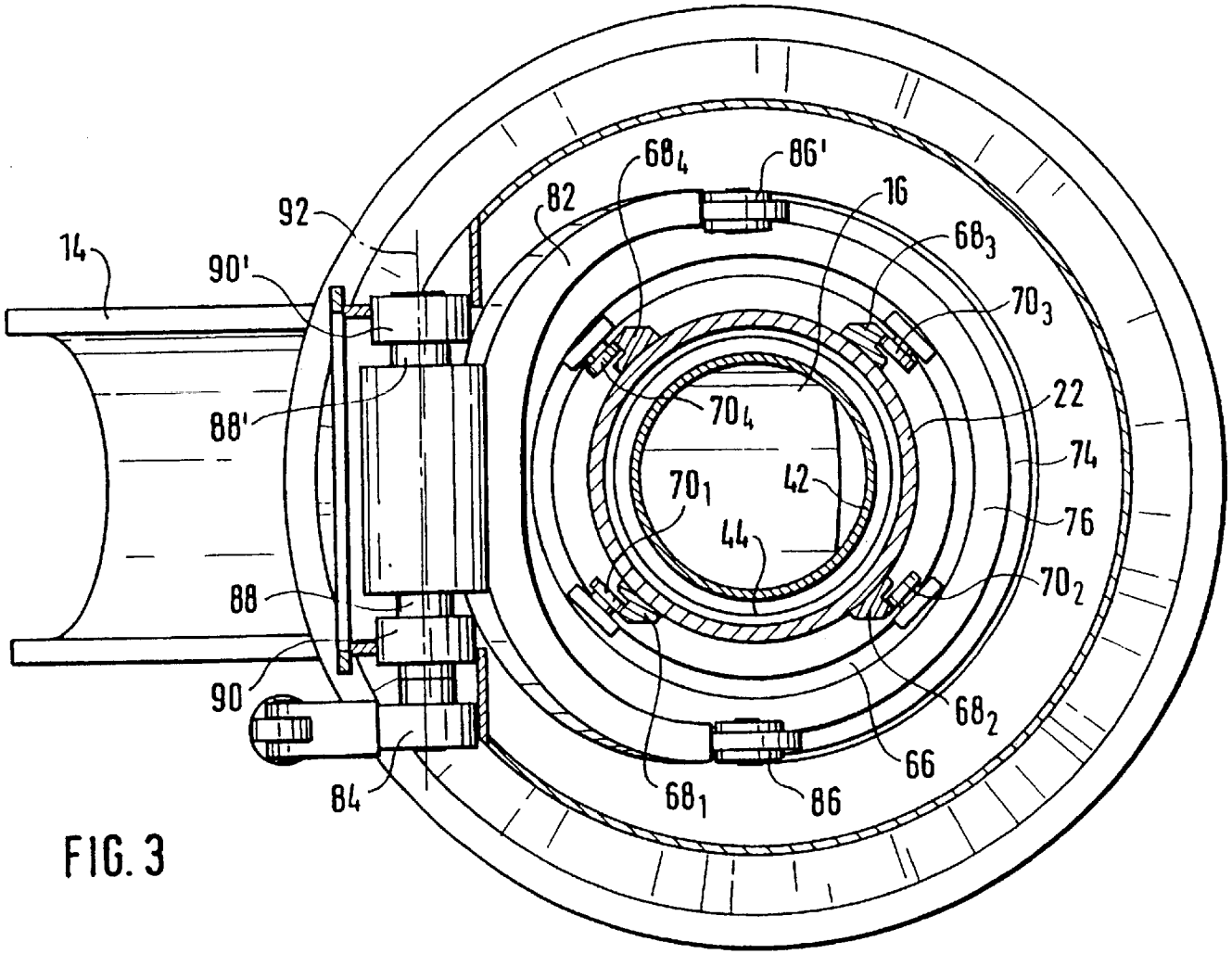
Figure 4:
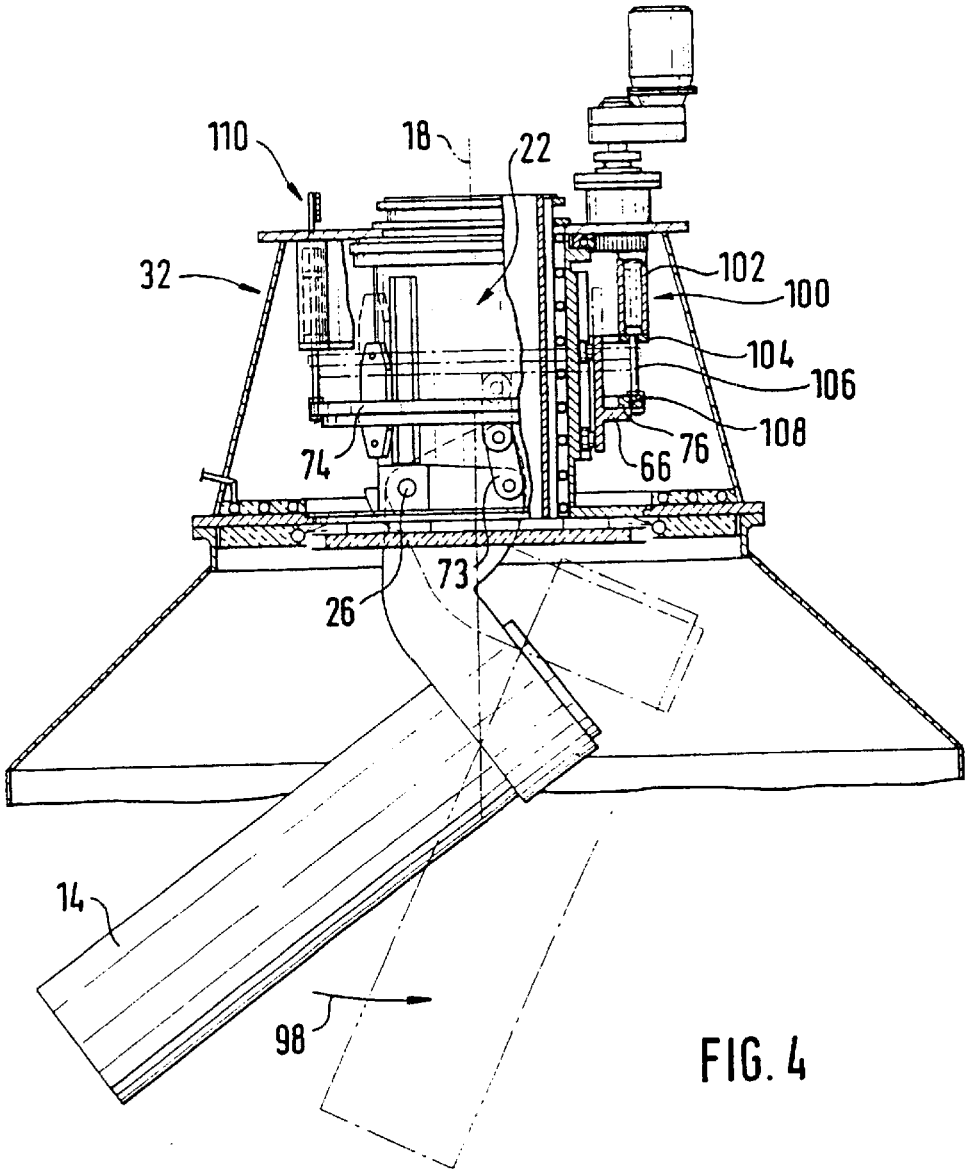
Figure 5:
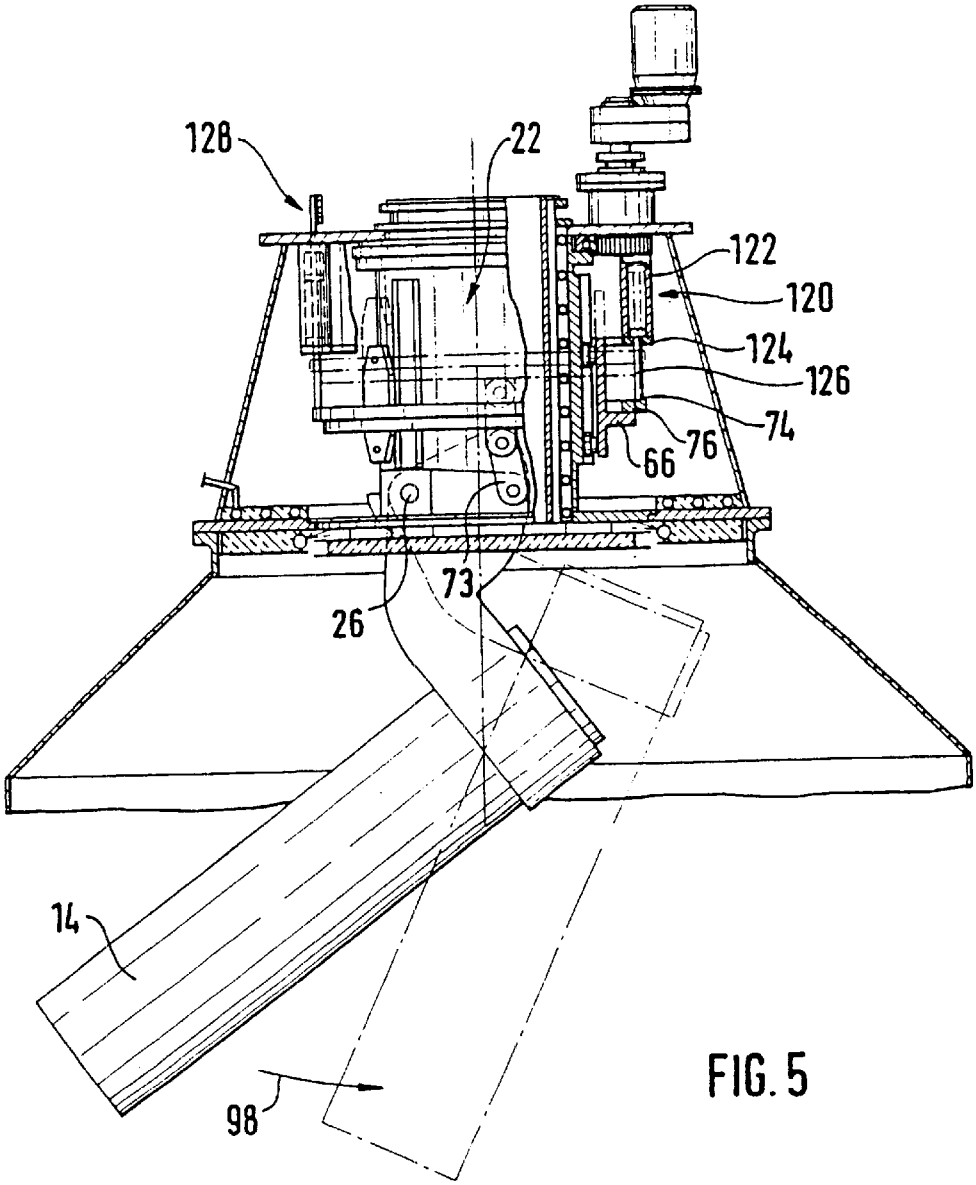

Other special features and characteristics of the invention will emerge from the detailed description of several advantageous embodiments given below, as illustrative examples, making reference to the appended drawings. The said drawings show:

FIG. 1: a vertical cross-section through a first embodiment of a device for distributing materials in bulk, FIG. 2: a cross-section along the line 2—2 in FIG. 1;

FIG. 3: a cross-section along the line 3—3 in FIG. 1;

FIG. 4: a vertical cross-section through a second embodiment of a device for distributing materials in bulk;

FIG. 5: a vertical cross-section through a third embodiment of a device for distributing materials in bulk.

In these figures, the same reference numbers indicate identical or similar elements.

FIG. 1 shows a diagrammatic representation of a device for distributing materials in bulk 12 with a rotary chute 14 having a variable angle of inclination. This device is mounted on the top of a shaft furnace 10 and forms part of an installation for charging the said furnace. It is fed by a batch hopper (not shown) which opens into a central feed channel 16 of the device 12. The reference number 18 indicates the central axis of the feed channel 16, which will normally be coaxial with the central axis of the shaft furnace 10.

In FIG. 1, the chute 14 is shown in two inclined positions. The full lines show it with an inclination so that it deflects the material in bulk flowing through the feed channel 16 into the peripheral zone of the furnace. The broken lines show it with an inclination such that the material in bulk is delivered into the central zone of the shaft furnace 10.

The device for distributing materials in bulk 12 will now be examined in more detail by referring simultaneously to FIGS. 1 to 3. The chute 14 is provided at its upper end with two lateral suspension arms 20, 20' (in FIG. 1, the arm 20' is hidden by the arm 20). A suspension rotor 22, suspended in a supporting cage 32 so that it can rotate about the axis 18, supports two suspension bearings 24, 24'. A suspension arm 20, 20' of the chute 14 is mounted in each of these two suspension bearings 24, 24' so that these two bearings 240, 240' define for the chute 14 a substantially horizontal pivoting axis. This pivoting axis is denoted by the reference number 26 in FIG. 2.

The rotor 22 may be likened to a tube surrounding the feed channel 16; it carries the bearings 24, 24' at its lower end and has a suspension flange 30 at its upper end. A large diameter bearing 28, mounted on the suspension flange 30, suspends the rotor 22 in the supporting cage 32 so as to define its rotation axis 18. An electric or hydraulic motor 34 (preferably a motor with a variable speed of rotation) is used to drive in rotation the rotor 22, and hence also the chute 14, about the axis 18. For this purpose, a pinion 36 on the driving motor 34 meshes with an annular gear 38 carried, for example, by the suspension flange 30.

The supporting cage 32 is a sealed structure itself supported on the top of the shaft furnace 10. It has at its upper end a plate 40 provided with an opening for the passage of the wearing tube 42, which defines the feed channel 16. Advantageously inserted in an annular space remaining between the rotor 22 and the wearing tube 42 is a non-rotatable screen 44 fitted with a closed cooling circuit. This cooling screen 44 is used mainly to cool the inner surface of the rotor 22.

At its lower end, the structure 32 is provided with an annular screen 46. The said screen is fitted with a cooling circuit 48 on its upper surface and with thermal insulation 50 on its lower surface. It defines a central opening in which is set a flange 52 equipping the lower end of the suspension rotor 22. The flange 52 comprises an upper plate 54, which is protected at the bottom by thermal insulation 56. Between the upper plate 54 and the thermal insulation 56 there remains an empty space 58 accessible from the lateral edge of the flange 52. A pipe 60 is located along the central opening in the fixed annular screen 46. This pipe 60 is connected to a source of coolant gas and it is provided over the whole of its length with outlets oriented in such a way that they can inject this coolant gas through outlets 58 into cavities in the flange 52.

It remains to point out that the flange 52 is provided with two slits for the passage of the suspension arms 20, 20' of the chute 14. Because the arms 20, 20' are delimited at the level of the two ends of the passage slits by cylindrical surfaces 62, 64 whose axes coincide with the pivoting axis of the chute 14, the arms 20, 20' ensure that the passage slits are almost completely blocked for any angle of inclination of the chute 14.

The mechanism making it possible to change the inclination of the chute 14 will now be described in more detail with the help of FIGS. 1 and 3. The reference number 66 refers to a first ring located around the rotor 22 so that its central axis is coaxial with the rotation axis of the said rotor. This first ring 66 is connected to the rotor 22 through the intermediary of a guidance device which allows the first ring to slide axially along the rotor 22. In a preferred embodiment, this guidance device comprises guide rails $\mathbf{68}_1 \ldots \mathbf{68}_4$ and guide rollers $\mathbf{70}_1 \ldots \mathbf{70}_4$. The guide rails $\mathbf{68}_1 \ldots \mathbf{68}_4$ are fixed vertically on the outer wall of the rotor 22. The guide rollers $\mathbf{70}_1 \ldots \mathbf{70}_4$ are mounted on the first ring 66 and are guided vertically in the rails $\mathbf{68}_1 \ldots \mathbf{68}_4$ in order to centre the first ring 66 with respect to the rotor 22 during its vertical sliding. Excellent centring of the ring 66 in the rails $\mathbf{70}_1 \ldots \mathbf{70}_4$ is obtained when each guide rail $\mathbf{68}_1 \ldots \mathbf{68}_4$ is associated with a pair of guide rollers $\mathbf{70}_1$, $\mathbf{70}_1'$ (see FIG. 1) which are mounted with vertical separation on the supporting arms 72, 72' fixed to the first ring 66. A connecting rod 73, 73' connects the first ring 66 to each of the suspension arms 20, 20' of the chute 14. These connecting rods 73, 73' convert a vertical displacement of the first ring 66 into a pivoting of the chute 14 about its pivoting axis 26. The reference number 74 refers to a second ring positioned around the rotor 22 so that its central axis is coaxial with the rotation axis 18 of the said rotor. A large-diameter bearing ring 76 connects this second ring 74 to the first ring 66. This bearing ring 76 allows a relative rotation of the two rings 66, 74 while providing for a transmission of vertical forces. It follows that non-rotatable means of control may be connected to the second ring 74 to vary the vertical position of the first ring 66 on the rotating suspension rotor 22.

A first embodiment of these means of control can be seen in FIGS. 1 and 3. This is a lever mechanism actuated by a hydraulic jack 80 installed outside the supporting cage 32. The lever mechanism comprises an intermediate articulated lever provided with a supporting arm 82 and an actuating arm 84. It can be seen in FIG. 3 that the supporting arm 82 has the shape of a fork, which is connected by two connecting rods 86, 86' to the second ring 74 at two diametrically opposite points. A front view of the connecting rod 86 can be seen in FIG. 1. The lever comprises two suspension pivots 88, 88' housed in the suspension bearings 90, 90'. The latter are supported by the supporting cage 32 so as to define for the lever a substantially horizontal pivoting axis 92. The actuating arm 84 is carried by the suspension pivot 88, which leaves the supporting cage 32 imperviously through the suspension bearing 90. The hydraulic jack 80 is connected between the actuating arm 84 and a supporting arm 94, which is fixed rigidly to the supporting cage 32.

In FIG. 1, a shortening of the hydraulic jack 80 causes the lever 82, 84 to pivot about its pivoting axis 92 in the direction of the arrow 96. The supporting arm 82 raises, by means of the connecting rods 86, 86', the second ring 74. The latter raises, by means of the bearing ring 76, the first ring 66, which is rotating with the suspension rotor 22 about the axis 18. The connecting rods 73, 73' then make the chute 14 pivot about its pivoting axis 26 in the direction of the arrow 98. Because the centre of gravity of the chute, in the initial position of the chute (i.e. the position shown by full lines), is to the right of the vertical plane containing the pivoting axis 26 of the chute 14, it is sufficient to release the jack 80 to make the chute pivot in the direction opposite that of the arrow 98 under the effect of its own weight.

FIG. 4 shows a second embodiment of the means of control for varying the vertical position of the second ring 74. These involve hydraulic jacks uniformly distributed in the supporting cage 32 around the rotor 22. The casings 102 of these jacks 100 are supported vertically by a fixed ring 104, which is fixed to the supporting cage 32 vertically above the second ring 74. The pistons 106 of these jacks 100 are connected, preferably using a ball and socket joint 108, to the second ring 74. A shortening of these hydraulic jacks 100 raises the second ring 74. The latter, through the intermediary of the bearing ring 76, raises the first ring 66, which is rotating with the suspension rotor 22 about the axis 18. The connecting rods 73, 73' then make the chute 14 pivot about its pivoting axis 26 in the direction of the arrow 98. It remains to note that reference number 110 refers to an indicator of the position of the hydraulic jacks 100.

FIG. 5 shows a third embodiment of the means of control for varying the vertical position of the second ring 74. These involve an annular hydraulic jack 120 located around the rotor so that its central axis is coaxial with the rotation axis of the said rotor. The annular hydraulic jack comprises an annular casing 122, which is supported vertically by a fixed ring 124, which is fixed to the supporting cage 32 vertically above the second ring 74. Its annular piston 126, which is locked in rotation, is fixed to the second ring 74. The reference number 128 refers to an indicator of the position of the annular hydraulic jack 120.

What is claimed is:

1. A device for distributing materials in bulk comprising:

a supporting cage;

a suspension rotor mounted in said supporting cage so that it can rotate about a substantially vertical rotation axis;

a chute for distributing said materials in bulk, said chute being suspended from said suspension rotor so that it rotates with said suspension rotor and so that it can pivot about a substantially horizontal suspension axis;

a feed channel which passes through said suspension rotor for feeding said materials in bulk on said chute;

a driving means to drive said suspension rotor about its rotation axis; and a pivoting mechanism to make said chute pivot about its suspension axis and thus to change an inclination of said chute, said pivoting mechanism for said chute including:

a first ring surrounding said suspension rotor so that its central axis is coaxial with said rotation axis of said rotor;

a guidance device locked in rotation relative to said suspension rotor and connected between said suspension rotor and said first ring so that said first ring can slide axially along said suspension rotor;

at least one connecting element that connects said first ring to said chute so as to convert a vertical sliding of said first ring into a pivoting movement of said chute;

a second ring surrounding said suspension rotor so that its central axis is coaxial with said rotation axis of said rotor;

a bearing ring connecting said first ring to said second ring; and an annular hydraulic jack surrounding said suspension rotor so that its central axis is coaxial with said rotation axis of said rotor, said annular hydraulic jack being connected to said second ring for varying the vertical position of said second ring.

2. The device according to claim 1, wherein:

said chute comprises two lateral suspension arms; and said suspension rotor comprises two lateral bearings in which said suspension arms are suspended so that said chute can pivot about a substantially horizontal axis.

3. The device according to claim 2, further comprising:

connecting rods connecting said first ring to each of said suspension arms of said chute so as to convert a vertical sliding of said first ring into a pivoting of said chute about its pivoting suspension axis.

4. The device according to claim 1, wherein said guidance device includes:

plural vertical guiding rails mounted on said suspension rotor; and guiding rollers mounted on said first ring, said guiding rollers being guided in said vertical guiding rails.

5. The device according to claim 4, wherein said guidance device includes for each of said vertical guiding rails a pair of vertically separated guiding rollers.

6. The device according to claim 1, wherein said annular hydraulic jack includes an annular piston which is locked in rotation with and fixed to said second ring.

7. The device according to claim 1, wherein:

said annular hydraulic jack includes an annular casing; and said supporting cage includes a support ring, which is fixed vertically above said second ring and supports said annular casing.

8. The device according to claim 1, further comprising:

a non-rotatable tubular screen inserted between said feed channel and said suspension rotor, and a cooling circuit arranged on said tubular screen.

9. The device according to claim 1, wherein:

said supporting cage and said suspension rotor each have a lower end;

said lower end of said supporting cage has an annular screen rigidly fixed thereto, so as to define a circular central opening at said lower end;

said annular screen is equipped with a cooling circuit; and said lower end of said suspension rotor has a annular flange rigidly fixed thereto, so as to define a clearance fit in said circular central opening of said annular screen.

10. The device according to claim 9, wherein:

said annular flange has a lateral edge giving access to an empty space in said annular flange;

said supporting cage has a gas injection pipe arranged along said circular central opening of said fixed annular screen, so as to be able to inject a coolant gas through said lateral edge into said empty space in said annular flange.

11. The device according to claim 10, wherein:

said annular flange includes an upper plate and a thermal insulation arranged below said upper plate, said empty space being defined between said upper plate and said thermal insulation.

12. The device according to claim 9, wherein:

said chute includes two lateral suspension arms;

said suspension rotor includes two lateral bearings in which said suspension arms are suspended so that said chute can pivot about a substantially horizontal axis, said suspension bearings being located above said annular flange;

said annular flange is provided with two slits for the passage of said two suspension arms; and said suspension arms are delimited at a level of said passage through said slits by cylindrical surfaces whose axes coincide with said suspension axis of said chute, so that said suspension arms almost completely close said slits independently of an angle of inclination of said chute.

* * * * *